US011420711B2

(12) United States Patent
Vogel et al.

(10) Patent No.: US 11,420,711 B2
(45) Date of Patent: Aug. 23, 2022

(54) STRUCTURE AND ASSEMBLY FOR RECESSED DECK PORTION IN PONTOON BOAT

(71) Applicant: Polaris Industries Inc., Medina, MN (US)

(72) Inventors: Jacob Steven Vogel, Granger, IN (US); Brad Roy Fishburn, Nappanee, IN (US); Blair A. Donat, Elkhart, IN (US)

(73) Assignee: Polaris Industries Inc., Medina, MN (US)

( * ) Notice: Subject to any disclaimer, the term of this patent is extended or adjusted under 35 U.S.C. 154(b) by 34 days.

(21) Appl. No.: 16/990,477

(22) Filed: Aug. 11, 2020

(65) Prior Publication Data

US 2020/0391824 A1 Dec. 17, 2020

Related U.S. Application Data

(63) Continuation of application No. 15/827,154, filed on Nov. 30, 2017, now Pat. No. 10,793,228.
(Continued)

(51) Int. Cl.
*B63B 3/48* (2006.01)
*B63B 35/613* (2006.01)
(Continued)

(52) U.S. Cl.
CPC ..... *B63B 3/48* (2013.01); *B63B 1/121* (2013.01); *B63B 1/125* (2013.01); *B63B 29/04* (2013.01);
(Continued)

(58) Field of Classification Search
CPC ..... B63B 3/48; B63B 1/121; B63B 1/125; B63B 29/04; B63B 35/34; B63B 35/613; B63B 2029/043
See application file for complete search history.

(56) References Cited

U.S. PATENT DOCUMENTS 31,563 A 2/1861 Seibert et al.
717,662 A 1/1903 Ellison
(Continued)

FOREIGN PATENT DOCUMENTS

FR 2387840 A1 11/1978
FR 2636295 A1 3/1990
(Continued)

OTHER PUBLICATIONS

World Champion Watercraft components. Product sheet [online]. River Pot Design, 2001, [retrieved on Jul. 2, 2003]. Retrieved from the Internet: <URL:web.archive.org/web/20010926015150/http://www.rpotdesign.com/.
(Continued)

*Primary Examiner* — Anthony D Wiest
(74) *Attorney, Agent, or Firm* — Faegre Drinker Biddle & Reath LLP

(57) ABSTRACT

A pontoon boat is provided that includes at least two pontoons running longitudinally beneath the boat and providing buoyancy thereto; a deck framework mounted above and connected to the pontoons; a deck mounted on the deck framework; a recessed deck portion extending downwardly through the deck and the deck framework, the recessed deck portion forming a cavity into the deck including a bottom and side walls forming a basin extending into and beneath the deck; and at least one seat adjacent the recessed deck portion and mounted to the deck.

23 Claims, 13 Drawing Sheets

Related U.S. Application Data

(60) Provisional application No. 62/429,375, filed on Dec. 2, 2016.

(51) Int. Cl.
*B63B 1/12* (2006.01)
*B63B 35/34* (2006.01)
*B63B 29/04* (2006.01)

(52) U.S. Cl.
CPC ..... *B63B 35/34* (2013.01); *B63B 35/613* (2013.01); *B63B 2029/043* (2013.01)

(56) References Cited

U.S. PATENT DOCUMENTS 731,515 A 6/1903 Sheen et al.
998,437 A 7/1911 Wieland
1,202,713 A 10/1916 Hedges
1,448,921 A 3/1923 Ershkowitz
1,646,266 A 10/1927 Stoner
2,233,254 A 2/1941 Elling
2,249,958 A 7/1941 Inwood
2,448,075 A 8/1948 Bortner
2,491,609 A 12/1949 George
2,821,989 A 2/1958 Shepard
2,910,033 A 10/1959 Weisburg
2,919,669 A 1/1960 Kikuhara
2,959,146 A 11/1960 Erkert
2,990,802 A 7/1961 Eric et al.
3,002,484 A 10/1961 Dube
3,065,724 A 11/1962 Tritt
3,067,711 A 12/1962 Hesher et al.
3,103,947 A 9/1963 Mueller
3,115,860 A 12/1963 Payne
3,130,852 A 4/1964 Cook
3,230,918 A 1/1966 Compton
3,352,447 A 11/1967 Hahn
3,361,227 A 1/1968 Kaari
3,363,598 A 1/1968 Mortrude
3,369,518 A 2/1968 Jacobson
3,401,663 A 9/1968 Yost
3,405,677 A 10/1968 Smith
3,456,613 A 7/1969 Smith
3,481,297 A 12/1969 Mantle
3,485,198 A 12/1969 Matthews
3,548,773 A 12/1970 Laughlin
3,614,937 A 10/1971 Schluman
3,648,641 A 3/1972 Normand, Jr.
3,685,061 A 8/1972 Wray
3,695,210 A 10/1972 Stein
3,702,106 A 11/1972 Wilder
3,707,936 A 1/1973 Harris
3,782,320 A 1/1974 Groves
3,829,153 A 8/1974 Fussell et al.
3,908,797 A 9/1975 Schnepp
3,937,173 A 2/1976 Stuart
3,981,721 A 9/1976 Takashima
3,996,871 A 12/1976 Boismard
4,005,674 A 2/1977 Davis
4,019,456 A 4/1977 Harbert
4,051,801 A 10/1977 Woodfill et al.
4,056,211 A 11/1977 Zumwalt
4,084,533 A 4/1978 Boyer
4,084,536 A 4/1978 Stansbury
4,100,877 A 7/1978 Scott et al.
4,223,630 A 9/1980 Keeney
4,247,232 A 1/1981 McCreery et al.
4,311,317 A 1/1982 Bartels
D263,293 S 3/1982 Janson
4,320,713 A 3/1982 Nishida et al.
4,348,972 A 9/1982 Parsons
4,385,580 A 5/1983 Davidson
4,404,714 A 9/1983 Duran
4,413,215 A 11/1983 Cavil et al.
4,420,741 A 12/1983 West
4,448,430 A 5/1984 Bright
4,509,927 A 4/1985 Ikeda
4,568,293 A 2/1986 Yazaki
4,588,220 A 5/1986 Matsui et al.
4,609,360 A 9/1986 Whitehead
4,616,168 A 10/1986 Nishida
4,629,434 A 12/1986 Monreal
4,643,685 A 2/1987 Nishida
4,678,444 A 7/1987 Monreal
4,688,508 A 8/1987 Nishida
4,690,094 A 9/1987 Taylor
4,706,702 A 11/1987 Grasseschi
4,709,648 A 12/1987 Andrews
4,744,325 A 5/1988 Nobayashi
4,756,332 A 7/1988 Grasseschi
4,760,810 A 8/1988 Kobayashi
4,762,078 A 8/1988 Palmer, Jr.
4,799,444 A 1/1989 Lisowski
4,824,409 A 4/1989 Kobayashi
4,840,592 A 6/1989 Anderson
4,870,843 A 10/1989 Lundberg
4,875,882 A 10/1989 Plitt et al.
4,875,884 A 10/1989 Meisenburg
4,896,621 A 1/1990 Coles
4,907,520 A 3/1990 Pipkorn
4,917,037 A 4/1990 Hargett, Sr.
4,924,798 A 5/1990 Lathers
4,926,783 A 5/1990 Lathers
4,932,347 A 6/1990 Mardikian
4,941,854 A 7/1990 Takahashi et al.
4,942,837 A 7/1990 Hellmann et al.
4,942,838 A 7/1990 Boyer et al.
4,947,781 A 8/1990 Norman
4,964,357 A 10/1990 Genfan
RE33,488 E 12/1990 Kobayashi
4,982,682 A 1/1991 Hattori
4,986,777 A 1/1991 Preston
4,989,409 A 2/1991 Nakase et al.
4,997,399 A 3/1991 Nakayasu et al.
4,998,966 A 3/1991 Yamaguchi
5,005,963 A 4/1991 Schmidt et al.
5,007,870 A 4/1991 Okubo et al.
5,036,789 A 8/1991 Kelly et al.
5,037,687 A 8/1991 Kargarzadeh et al.
5,043,727 A 8/1991 Ito
5,049,096 A 9/1991 Henn
5,062,815 A 11/1991 Kobayashi
5,064,157 A 11/1991 O'Neal
5,067,448 A 11/1991 Nakase et al.
5,067,918 A 11/1991 Kobayashi
5,076,188 A 12/1991 Burroughs
5,086,725 A 2/1992 Garrett
5,096,208 A 3/1992 Westberg
5,096,753 A 3/1992 McCue et al.
5,097,789 A 3/1992 Oka
5,101,753 A 4/1992 Hull et al.
5,135,239 A 8/1992 Kato et al.
5,141,456 A 8/1992 Langenberg et al.
5,149,569 A 9/1992 McCue
5,151,057 A 9/1992 Kobayashi et al.
5,154,650 A 10/1992 Nakase
5,184,564 A 2/1993 Robbins et al.
5,199,373 A 4/1993 Mardikian
5,199,913 A 4/1993 Toyohara et al.
5,216,421 A 6/1993 Sawada et al.
5,234,364 A 8/1993 Ito
5,239,884 A 8/1993 Norsen
5,255,626 A 10/1993 Hattori et al.
5,256,092 A 10/1993 Jones
D343,160 S 1/1994 LaPointe
5,289,997 A 3/1994 Harris
5,296,973 A 3/1994 Burke
5,303,667 A 4/1994 Zirkelbach et al.
5,304,078 A 4/1994 Kaneko
5,312,275 A 5/1994 Place
5,315,895 A 5/1994 Kattus et al.
5,329,871 A 7/1994 Gibbs
D349,879 S 8/1994 Jaramillo, Sr.
D350,325 S 9/1994 Mardikian

(56) References Cited

U.S. PATENT DOCUMENTS 5,350,325 A 9/1994 Nanami
5,355,826 A 10/1994 Hattori et al.
5,366,401 A 11/1994 Nanami et al.
5,367,977 A 11/1994 Ellis et al.
5,389,022 A 2/1995 Kobayashi
5,390,621 A 2/1995 Hattori et al.
5,399,111 A 3/1995 Kobayashi et al.
5,405,278 A 4/1995 Garland
5,413,063 A 5/1995 King
D359,469 S 6/1995 Yoshida et al.
D359,720 S 6/1995 Jaramillo, Sr.
5,438,946 A 8/1995 Kobayashi
5,447,116 A 9/1995 Kobayashi
5,449,305 A 9/1995 Kobayashi et al.
5,458,079 A 10/1995 Matthews et al.
5,462,292 A 10/1995 Yamane
5,464,301 A 11/1995 Kramer
5,474,007 A 12/1995 Kobayashi
5,490,474 A 2/1996 Ikeda
5,494,464 A 2/1996 Kobayashi et al.
5,503,419 A 4/1996 Gardner
5,507,672 A 4/1996 Imaeda
5,511,505 A 4/1996 Kobayashi et al.
5,520,139 A 5/1996 King et al.
5,524,597 A 6/1996 Hiki et al.
5,536,189 A 7/1996 Mineo
5,540,174 A 7/1996 Kishi et al.
5,544,607 A 8/1996 Rorabaugh et al.
5,551,898 A 9/1996 Matsumoto
5,556,314 A 9/1996 Fukuda et al.
5,572,943 A 11/1996 Kobayashi et al.
5,588,388 A 12/1996 Maruyama et al.
5,593,329 A 1/1997 Kato
5,603,644 A 2/1997 Kobayashi et al.
5,607,332 A 3/1997 Kobayashi et al.
5,613,459 A 3/1997 Remy
5,613,887 A 3/1997 Kobayashi
D380,437 S 7/1997 Saulters
5,655,473 A 8/1997 Arvilla
5,664,515 A 9/1997 Hattori et al.
5,669,326 A 9/1997 Ikeda
5,676,575 A 10/1997 Fukuda et al.
5,678,827 A 10/1997 Burian et al.
5,697,320 A 12/1997 Murray
5,699,750 A 12/1997 Schneider
5,706,752 A 1/1998 Menne et al.
5,707,264 A 1/1998 Kobayashi et al.
5,713,297 A 2/1998 Tani et al.
5,730,077 A 3/1998 Nunes et al.
5,735,229 A 4/1998 House et al.
5,743,204 A 4/1998 Tweet
5,743,206 A 4/1998 Hattori
5,752,864 A 5/1998 Jones et al.
5,752,867 A 5/1998 Koyanagi
5,755,601 A 5/1998 Jones
5,799,605 A 9/1998 Huse
5,803,104 A 9/1998 Pollen
D399,182 S 10/1998 Lapointe
5,826,532 A 10/1998 Elvestad
5,829,378 A 11/1998 Nunes et al.
5,868,455 A 2/1999 Springer et al.
5,882,796 A 3/1999 Wilson et al.
5,894,810 A 4/1999 Orr
5,899,779 A 5/1999 Hattori
5,904,114 A 5/1999 Wright
5,908,006 A 6/1999 Ibata
5,913,571 A 6/1999 Dystra et al.
5,915,329 A 6/1999 Watkins et al.
5,918,564 A 7/1999 Ohtsuka et al.
5,931,114 A 8/1999 Bartholomew
5,934,953 A 8/1999 Kobayashi
5,934,954 A 8/1999 Schott et al.
5,964,172 A 10/1999 Ikeda
6,000,355 A 12/1999 Hall
6,006,692 A 12/1999 Szukhent, Jr.
6,010,140 A 1/2000 Guynn
6,010,378 A 1/2000 Fujimoto et al.
6,016,762 A 1/2000 Price
6,022,253 A 2/2000 Ozawa et al.
6,032,605 A 3/2000 Takashima
6,035,802 A 3/2000 Lussier
6,041,727 A 3/2000 Yamada et al.
6,050,867 A 4/2000 Shields et al.
6,066,014 A 5/2000 Smith et al.
6,085,685 A 7/2000 Morishige
6,089,932 A 7/2000 Nanami et al.
6,095,876 A 8/2000 Ozawa et al.
6,105,527 A 8/2000 Lochtefeld et al.
6,112,685 A 9/2000 Matsuda et al.
6,115,860 A 9/2000 Vrzalik
6,116,182 A 9/2000 Koyanagi
6,135,832 A 10/2000 Suzuki
6,139,381 A 10/2000 Suzuki et al.
6,145,458 A 11/2000 Hattori
6,152,587 A 11/2000 Berg
6,158,378 A 12/2000 Tsumiyama et al.
6,182,590 B1 2/2001 Patera
6,224,440 B1 5/2001 Shimizu
6,237,522 B1 5/2001 Kiyohara et al.
6,250,983 B1 6/2001 Paterson
D444,761 S 7/2001 Momoi et al.
6,260,505 B1 7/2001 Polidan
6,276,290 B1 8/2001 Yamada et al.
6,308,650 B1 10/2001 Tsumiyama et al.
6,322,409 B1 11/2001 Hattori et al.
6,345,585 B1 2/2002 Hovda et al.
6,349,662 B1 2/2002 Limansky et al.
6,349,666 B1 2/2002 Hastings
6,375,527 B2 4/2002 Gohara
6,379,204 B2 4/2002 Bolen
6,419,533 B2 7/2002 Lecours
6,435,924 B2 8/2002 Ishino
D462,644 S 9/2002 Aselton et al.
D463,355 S 9/2002 Bucaccio et al.
D463,770 S 10/2002 Aselton et al.
D464,015 S 10/2002 Bucaccio et al.
D464,016 S 10/2002 Orr et al.
6,457,433 B1 10/2002 Nagata
6,471,557 B1 10/2002 Hattori
6,471,558 B1 10/2002 Nakatsuji et al.
D465,191 S 11/2002 Bucaccio et al.
D465,192 S 11/2002 Bucaccio et al.
6,491,557 B2 12/2002 Tamaki
6,506,086 B2 1/2003 Matsumoto
6,523,490 B1 2/2003 Watkins
6,546,884 B1 4/2003 Rodriguez
6,546,888 B2 4/2003 Bertrand et al.
6,547,611 B1 4/2003 Boroos et al.
6,553,928 B2 4/2003 Yamada et al.
6,578,508 B2 6/2003 Hattori et al.
D476,612 S 7/2003 Bills et al.
D476,613 S 7/2003 Bills et al.
D477,560 S 7/2003 Bills et al.
D478,034 S 8/2003 Bills et al.
D478,035 S 8/2003 Bills et al.
D482,316 S 11/2003 Bills et al.
6,647,916 B2 11/2003 Neese et al.
6,651,579 B1 11/2003 Wynne et al.
D485,799 S 1/2004 Nugteren et al.
6,672,241 B2 1/2004 Warfel et al.
6,675,736 B1 1/2004 Schreiber et al.
6,681,712 B1 1/2004 Andreae et al.
D487,246 S 3/2004 Bills et al.
D487,718 S 3/2004 Bills et al.
D487,883 S 3/2004 Bills et al.
6,712,016 B1 3/2004 Morisch et al.
D488,117 S 4/2004 Bills et al.
6,722,301 B2 4/2004 Nagata et al.
6,739,921 B2 5/2004 Nakajima et al.
6,755,704 B1 6/2004 Leinonen
6,755,705 B1 6/2004 Slattery
6,789,494 B2 9/2004 Neese et al.
6,807,920 B1 10/2004 Wynne
6,807,922 B1 10/2004 Bills et al.

(56) References Cited

U.S. PATENT DOCUMENTS

| | | | |
|---|---|---|---|
| 6,808,433 | B1 | 10/2004 | Slattery et al. |
| 6,820,569 | B2 | 11/2004 | Warfel et al. |
| 6,843,192 | B1 | 1/2005 | Nugteren et al. |
| 6,863,013 | B2 | 3/2005 | Noyes, Jr. |
| 6,863,582 | B1 | 3/2005 | Wynne |
| 6,880,475 | B1 | 4/2005 | Thompson |
| 6,932,012 | B1 | 8/2005 | Philips et al. |
| 6,959,660 | B1 | 11/2005 | Packebush |
| 6,988,456 | B1 | 1/2006 | Schooler |
| 7,051,669 | B2 | 5/2006 | Warfel et al. |
| 7,107,926 | B2 | 9/2006 | Fishburn |
| 7,121,218 | B2 | 10/2006 | Stinson |
| 7,137,351 | B2 | 11/2006 | Picou |
| 7,240,632 | B1 | 7/2007 | Wynne et al. |
| 7,255,403 | B2 | 8/2007 | Butler |
| 7,267,590 | B1 | 9/2007 | Jones |
| 7,367,616 | B2 | 5/2008 | Summerford |
| 7,430,980 | B2 | 10/2008 | Fishburn |
| 7,490,896 | B2 | 2/2009 | Smith |
| 7,513,211 | B1 | 4/2009 | Farb et al. |
| 7,832,348 | B2 | 11/2010 | Newcomb |
| 8,028,641 | B1 | 10/2011 | Sly |
| 8,113,137 | B2 | 2/2012 | Thompson |
| 8,156,885 | B1 | 4/2012 | Beach |
| 8,474,393 | B1 | 7/2013 | Chandler |
| 9,415,836 | B1 | 8/2016 | Eekhoff et al. |
| D770,965 | S | 11/2016 | Deurr |
| D772,136 | S | 11/2016 | Deurr |
| D772,776 | S | 11/2016 | Deurr |
| 9,487,273 | B1 | 11/2016 | Eekhoff et al. |
| D780,087 | S | 2/2017 | Deurr |
| D784,902 | S | 4/2017 | Deurr |
| 9,873,487 | B1 | 1/2018 | Eekhoff et al. |
| 9,937,983 | B1 | 4/2018 | Duke |
| 9,944,354 | B1 * | 4/2018 | O'Neal ..... B63B 7/04 |
| 9,981,721 | B2 | 5/2018 | Deurr |
| 10,793,228 | B2 | 10/2020 | Vogel |
| 2001/0000052 | A1 | 3/2001 | Kamada et al. |
| 2001/0047744 | A1 | 12/2001 | Aselton et al. |
| 2002/0023579 | A1 | 2/2002 | Profitt et al. |
| 2002/0053310 | A1 | 5/2002 | Ibata et al. |
| 2002/0077007 | A1 | 6/2002 | Dagenais et al. |
| 2002/0182949 | A1 | 12/2002 | Tanaka et al. |
| 2003/0061975 | A1 | 4/2003 | Nadeau et al. |
| 2004/0048527 | A1 | 3/2004 | Yokoya |
| 2004/0058597 | A1 | 3/2004 | Matsuda |
| 2005/0098077 | A1 | 5/2005 | Blaisdell |
| 2006/0061154 | A1 | 3/2006 | Kahan |
| 2007/0283869 | A1 * | 12/2007 | Quinn ..... B63B 1/121 114/248 |
| 2010/0018451 | A1 | 1/2010 | Sahr |
| 2014/0048008 | A1 | 2/2014 | Kalil |
| 2017/0029069 | A1 * | 2/2017 | Deurr ..... B63B 1/125 |
| 2018/0154986 | A1 | 6/2018 | Vogel |

FOREIGN PATENT DOCUMENTS

| | | | |
|---|---|---|---|
| FR | 2806696 | A1 | 9/2001 |
| JP | 62-247994 | A | 10/1987 |
| JP | 08-031648 | A | 2/1996 |
| JP | 2002-337786 | A | 11/2002 |
| WO | 2007/045934 | | 4/2007 |

OTHER PUBLICATIONS

Office Action issued by the Canadian Intellectual Property Office, dated Jun. 18, 2020, for Canadian Patent Application No. 2,987,528; 4 pages.

* cited by examiner

STRUCTURE AND ASSEMBLY FOR RECESSED DECK PORTION IN PONTOON BOAT

This application is a continuation of U.S. patent application Ser. No. 15/827,154, filed Nov. 30, 2017, which claims the benefit of U.S. Provisional Patent Application Ser. No. 62/429,375 filed Dec. 2, 2016, the complete disclosures of which are hereby expressly incorporated by reference.

BACKGROUND OF THE INVENTION

The subject invention relates to a structure and assembly of a deck on a pontoon boat, and in particular to the deck having a recessed portion therein.

Boating has become an increasingly popular form of recreation, leisure and platform for water sports. One type of boat, namely, pontoon boats, which have two or more longitudinally extending floatation devices with buoyancy sufficient to float itself and its' deck, seats, and other boat equipment attached thereto as well as passengers, have also seen a rise in popularity. Pontoon boats provide an economical way to provide a large deck area accommodating many passengers as well as a smooth ride. Pontoon boats are particularly suited for lakes and rivers that do not have large waves.

It is desirable to increase the stability and lower the center of gravity of a pontoon boat to provide better handling and ride characteristics. Another advantage is the ability to have passengers more safely seated closer to the deck as well as the ability to provide a cabin of height that passengers can stand up in, yet minimizing the height of the cabin above the deck. Accordingly, the subject invention provides a means of doing so, utilizing a unique structure and assembly for a recessed deck portion in a pontoon boat.

It has been known to have an emergency watercraft including a pair of pontoons and a floor supported there between by a tubular frame as disclosed in U.S. Pat. No. 7,832,348 B2 to Newcomb. The floor may be rigid and also include rigid seats mounted atop each of the pontoons.

U.S. Pat. No. 2,233,254 to Elling discloses a lifeboat having a hull which is constructed of a metal material. The lifeboat includes a pair of longitudinally extending air tanks. Side air tanks can form longitudinally extending steps or seats, and a center tank is connected by braces to the side tanks.

U.S. Pat. No. 4,924,798 to Lathers discloses a recreational boat with a hull including a convertible seat/sleeper supported by the floor. The middle portion of the hull is recessed and serves for the placement of occupant's feet when the convertible arrangement is in the seat/dinette arrangement.

U.S. Pat. No. 4,917,037 to Hargett discloses a composite fiberglass and middle boat having a metal hull and a fiberglass interior lining. The interior lining has a forward attachment point, and the lining extends rearwardly to configure the shape of seat portions.

U.S. Patent Publication No. 2014/0048008 A1 to Kalil discloses a fiberglass pontoon boat including a flat recessed floor and integrated molded seats. FIGS. 1 and 2 of Kalil show prior art of a flat deck and frame mounted above pontoons; however, Kalil offers a completely different type of boat molded from a fiberglass material.

U.S. Pat. No. 8,156,855 B5 to Beach discloses a boat containing an emergency boat seating arrangement should the boat become capsized. The emergency seating arrangement consists of a plurality of chair assemblies imbedded in the bottom of the hull. The backs of the chairs fold up for use, leaving recessed areas in the bottom of the hull for placement of occupants' feet, should the boat become capsized.

U.S. Pat. No. 7,267,590 B1 to Jones et al. discloses a trolling boat having a hull with a central sunken section or portion forming a part of the top deck. The boat may be manufactured of a high density polyurethane using rotational molding or a vacuum process.

U.S. Pat. No. 7,121,218 to Stinson discloses a convertible bow arrangement that permits the bow to be changed between a flush deck configuration and an open bow configuration. In the flush deck configuration, a deck extension extends over and closes off the top of a footwell, and in the open bow configuration, the extension is folded beneath and stowed under a forward hatch.

None of the prior art discloses a traditional pontoon boat having a frame and deck mounted above the pontoons and including a recessed portion in the deck thereof.

SUMMARY OF THE INVENTION

In one embodiment of the invention, a pontoon boat is provided that includes at least two pontoons running longitudinally beneath the boat and providing buoyancy thereto; a deck framework mounted above and connected to the pontoons; a deck mounted on the deck framework; a recessed deck portion extending downwardly through the deck and the deck framework, the recessed deck portion forming a cavity into the deck including a bottom and side walls forming a basin extending into and beneath the deck; and at least one seat adjacent the recessed deck portion and mounted to the deck.

The recessed deck portion may have a rectangular cross-sectional configuration. Alternately, the recessed deck portion may have a cross-sectional configuration of an inverted U. In another embodiment, the recessed deck portion can have a cross-sectional configuration of a hemisphere extending downward from a rectangular area. In yet another embodiment, the recessed deck portion can have an angled bottom and sidewalls.

The recessed deck portion can be contained in a middle pontoon, a middle structure, or a partial hull extending longitudinally beneath the pontoon boat. The middle pontoon or hull portion includes may have a flange extending at least partially around the top thereof for mounting the pontoon to the deck framework. The pontoon boat can have two outer pontoons, and the outer pontoons are mounted to the deck framework with a plurality of support brackets. The deck framework may include a plurality of frame members extending transverse to the pontoons. The frame members can have a generally rectangular configuration.

The pontoon boat may also include a railing extending upwardly from and at least partially around the deck. The railing may include an upper ledge, and the upper ledge can include cup holders.

The pontoon boat can further include a liner covering at least a portion of the recessed deck portion The seats can be mounted flush to the deck, and occupants sitting in the seats can place their feet and legs in the recessed deck portion while in a comfortable seating position.

In another embodiment, a pontoon is that includes a cabin extending at least partially above the recessed deck portion. The recessed deck portion can include a flange extended at least partially around the sidewalls. The flanges of the recessed deck portion can be mounted to the deck framework.

In another configuration of the invention, the recessed deck portion can have a narrowed tapered section, and the tapered narrowed section can be located toward the bow of the pontoon boat

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
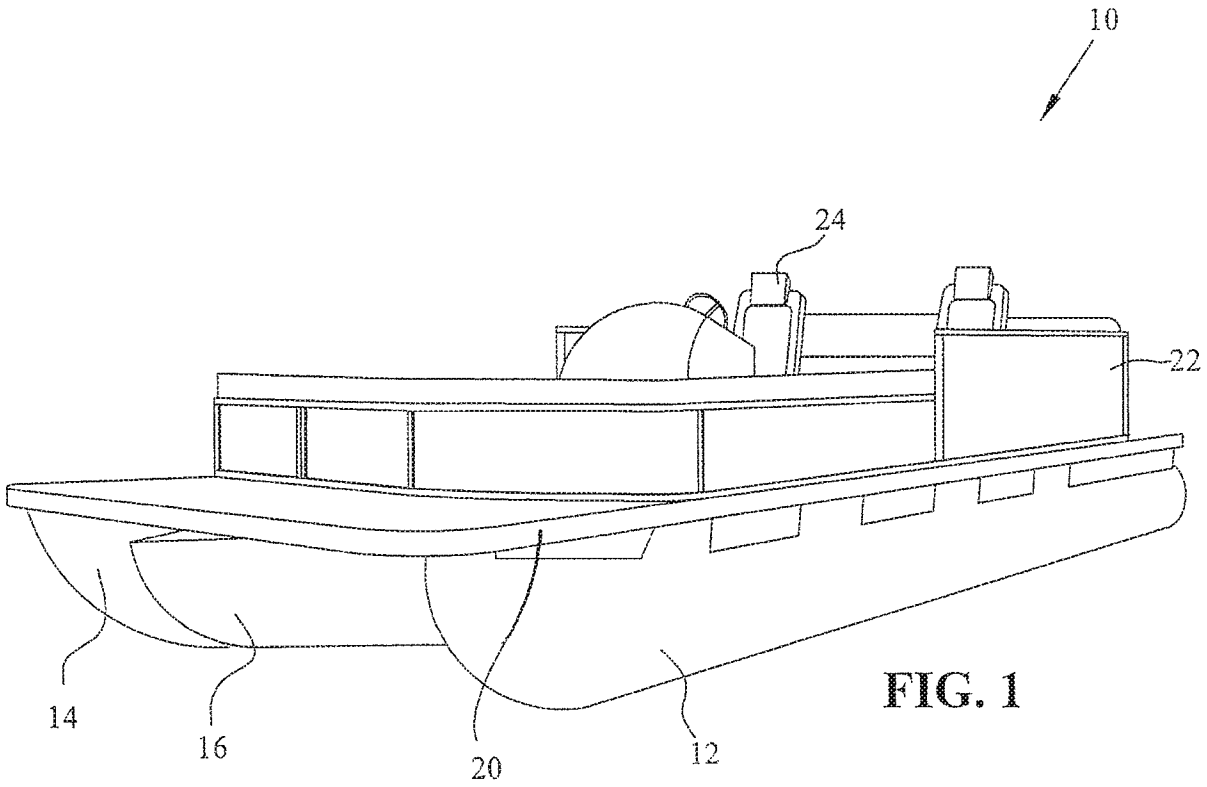
FIG. 1 is a perspective view of one embodiment of a pontoon boat having a recessed deck portion in accordance with the subject invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will, nevertheless, be understood that no limitation of the scope of the invention is thereby intended. The invention includes any alterations and further modifications in the illustrated devices and described methods and further applications of the principles of the invention, which would normally occur to one skilled in the art to which the invention relates.

Referring now to FIG. 1, one embodiment of a pontoon boat in accordance with the subject invention is shown generally indicated as 10. Pontoon boat 10 includes an outer pair of pontoons 12, 14 and a middle pontoon 16. The pontoons, as are well known, in the art are longitudinally extending buoyant members upon which pontoon boat 10 float and ride in a body of water. Pontoon boat 10 also includes a deck 20 mounted above the pontoons and extending in a generally horizontal plane. Pontoon boat 10 also includes a railing 22 extending around deck 20 for the safety of passengers on pontoon boat 10 meant to prevent passengers from unintentionally falling overboard. Pontoon boat 10 is also equipped with a plurality of seats 24 in which occupants may be seated while riding on pontoon boat 10.

Figure 2:
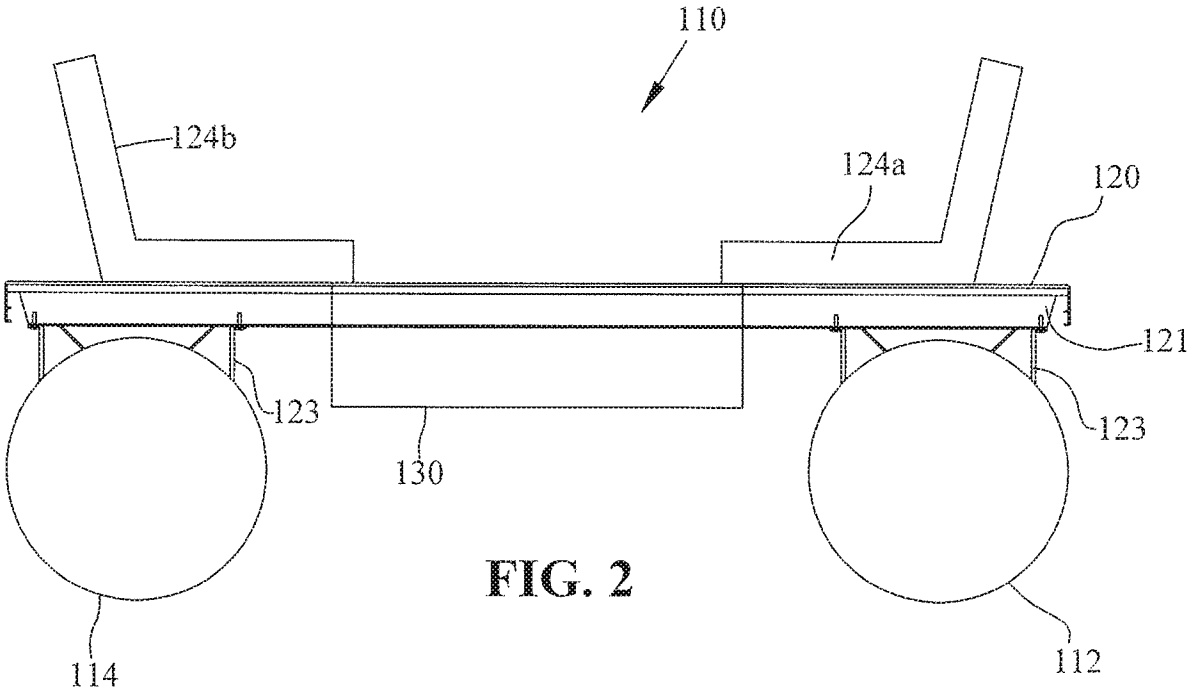
FIG. 2 is an end view drawing showing a configuration for one embodiment of a recessed deck portion in a pontoon boat.

As discussed above in the background of the invention, the subject invention relates to a recessed portion in the deck of a pontoon boat. For illustrative purposes, miscellaneous embodiments or configurations of recessed portions in a deck are illustrated in FIGS. 2-5. It should be noted that in FIGS. 2-10, all of the embodiments include two outer pontoons and the recessed deck portion may or may not be located in a middle pontoon, depending upon the desired number of pontoons and construct of the pontoon boat. Referring to FIG. 2, one embodiment of a pontoon boat having a recessed deck portion is shown generally indicated as 110. Pontoon boat 110 includes outer pontoons 112 and. Pontoon boat 110 also includes a deck 120 supported by a framework 121. Framework 121 is connected to pontoons 112 and 114 with bracket supports 123. Pontoon boat 110 also includes a pair of seats 124*a* and 124*b* mounted on deck 120 and a recessed deck portion 130 extending down from deck 120 in which passengers sitting in seats 124*a* and 124*b* may place and rest their feet. It should be appreciated that without recessed deck portion 130, seats 124*a* and 124*b* could not be mounted directly to deck 121 and still be a comfortable place for passengers to sit thereon. In other words, seats 124*a* and 124*b* would have to be mounted on platforms or frames attached to deck 120 to put them at a suitable seat height as is common on most pontoon boats and other boats. Recessed deck portion 130 has a generally rectangular configuration; however, other shapes and configurations may be employed for the recessed deck portion as shown in, but not limited by, FIGS. 3-5.

Figure 3:
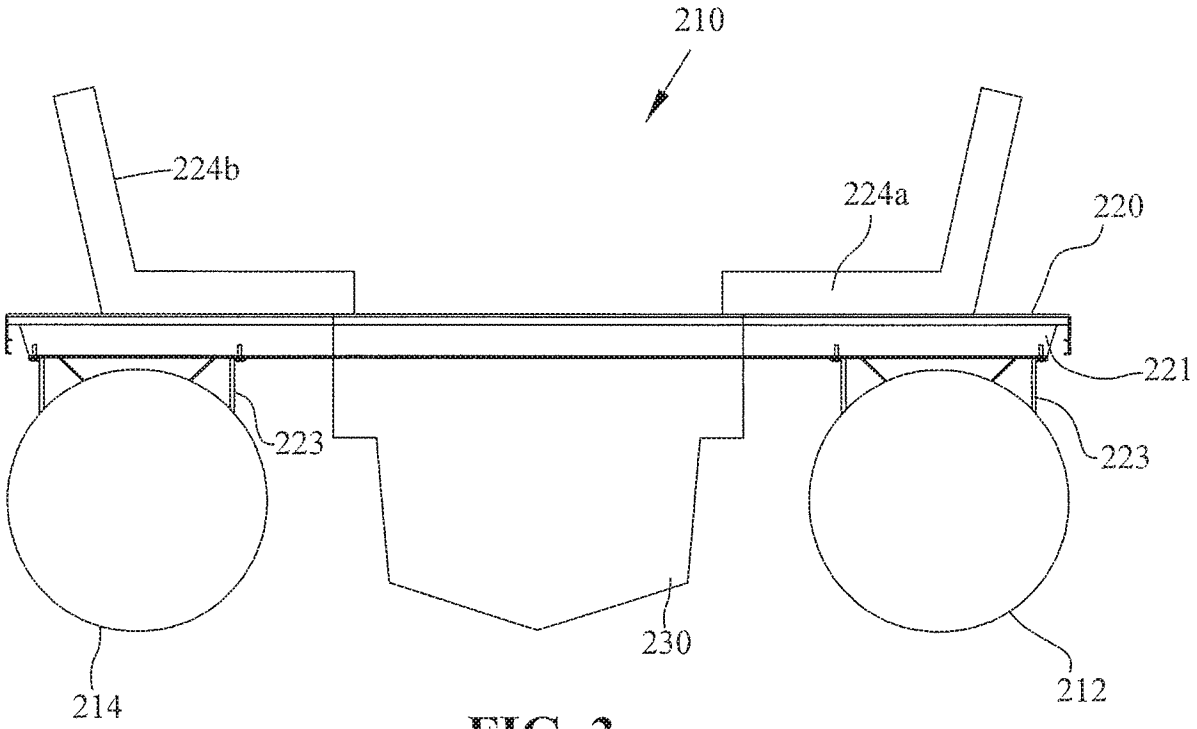
FIG. 3 is an end view drawing showing another configuration and embodiment of a recessed deck portion in a pontoon boat.

Now referring to FIG. 3, another embodiment of a pontoon boat having a recessed portion in its deck is shown generally indicated as 210. Pontoon boat 210 includes outer pontoons 212 and 214, and a deck 220 which is supported by a framework 221. Framework 221 is connected to pontoons 212 and 214 with brackets 223. Pontoon boat 220 also includes a pair of seats 224*a* and 224*b* mounted on deck 220 on opposite sides of the recessed deck portion 230, extending down from deck 220 and through framework 221. As can be readily seen, the configuration of recessed deck portion 230 provides ample room for passengers sitting in seats 224*a* and 224*b* to place their legs and feet. It should be appreciated, that recessed deck portion 230 may be a separate unit extending down from deck 220, extend down into a middle pontoon or be located in another structure, such as a hull portion, as may be desired.

Figure 4:
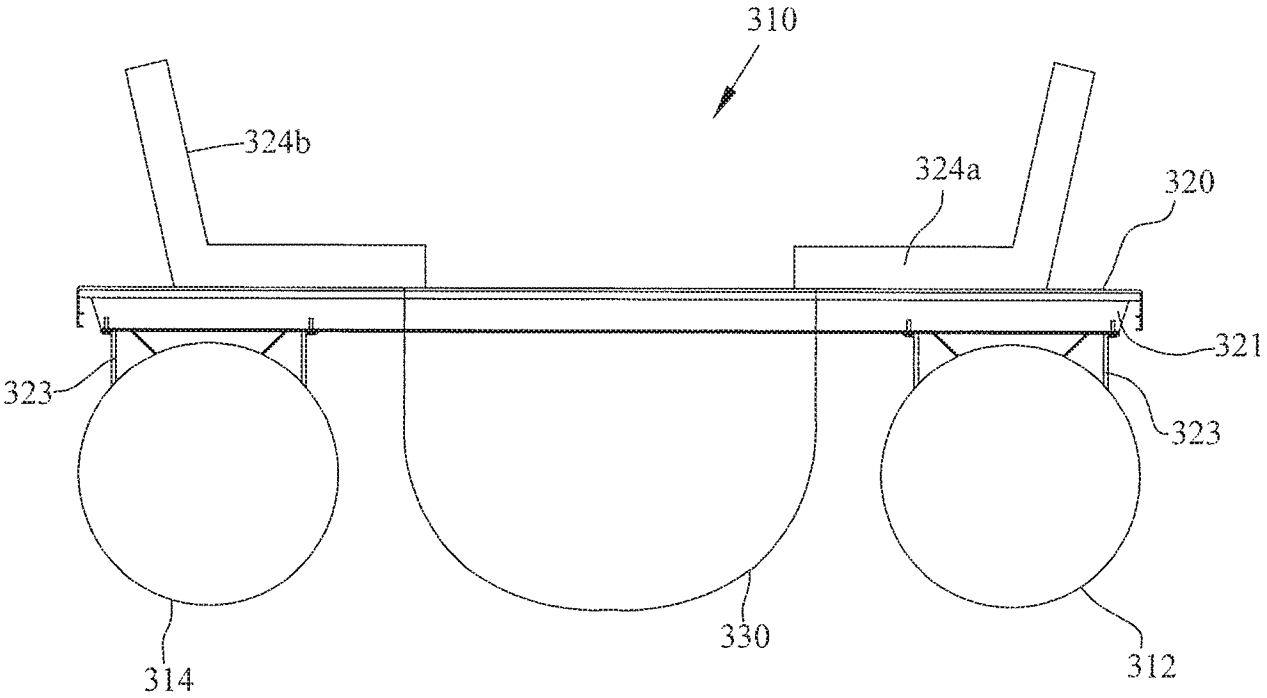
FIG. 4 is an end view drawing showing an additional configuration of an embodiment of a recessed deck portion in a pontoon boat.

Now referring to FIG. 4, another embodiment of a pontoon boat having a recessed deck portion is shown generally indicated as 310. In most respects, pontoon boat 310 is similar to pontoon boats 110 and 210, and includes a pair of outer pontoons 312, 314, and a deck 320 supported by a framework 321. Framework 321 is connected or attached to pontoons 312 and 314 with support brackets 323. Pontoon boat 310 also includes a pair of seats 324*a*, 324*b* facing one another and amounted to deck 320 on opposite sides of a recessed deck portion 330. As can be seen, recessed deck portion 330 has a cross sectional configuration similar to an inverted U and likewise provides abundant feet and legroom for occupants sitting in seats 324*a* and 324*b*. As with all of the recessed deck portions, deck portion 330 may be constructed as an independent unit extending down from deck 320 through framework 321 or may be encompassed in a middle pontoon or a partial hull structure.

Figure 5:
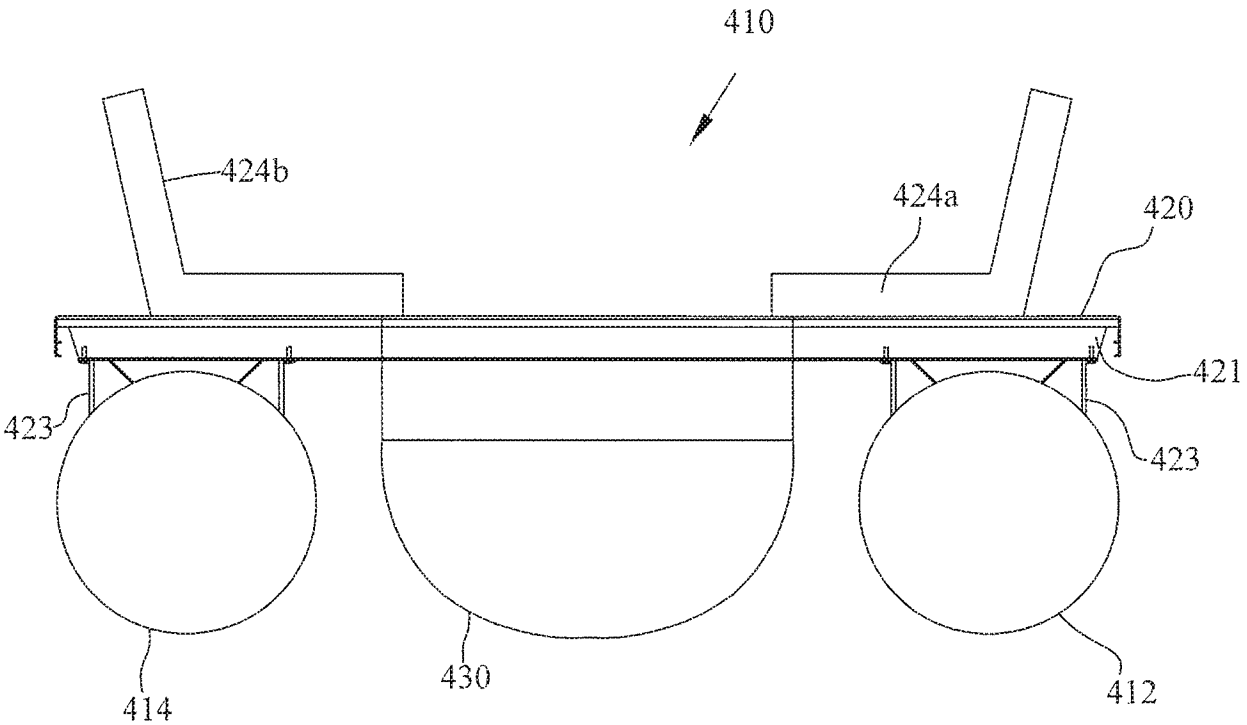
FIG. 5 is an end view drawing of another configuration of an embodiment of a recessed deck portion in a pontoon boat.

Now referring to FIG. 5, an embodiment of a pontoon boat is shown generally indicated as 410, which in most respects, except the configuration of the recessed deck portion, is similar to pontoon boats 110, 210, and 310. Pontoon boat 14 includes a pair of outer pontoons 412, 414, and a deck 420 mounted over the pontoons, the deck being supported by a framework 421, which is attached or connected to the pontoons with support brackets 423. Pontoon boat 410 also includes a pair of seats 424*a* and 424*b* mounted to deck 420 and facing one another and straddling a recessed deck portion 430. Recessed deck portion 430 has a cross-sectional configuration similar to a rectangle with an inverted hemisphere extending downwardly therefrom. Recessed deck portion 430 also has ample room for occupants of seats 424*a*, 424*b* to place their feet and legs.

Figure 6:
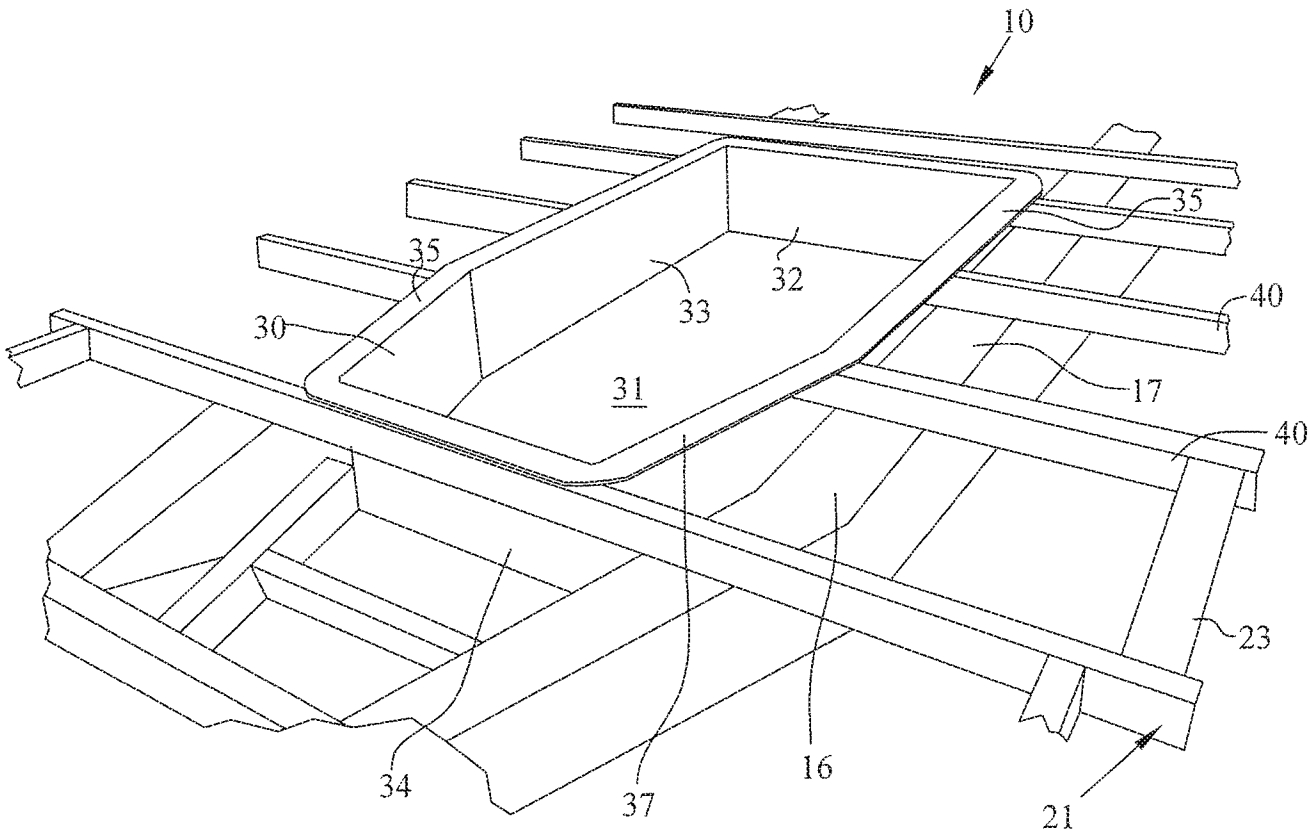
FIG. 6 is a perspective view of the bow of one embodiment of a pontoon deck frame assembly and recessed deck portion of the pontoon boat of FIG. 1.
Figure 7:
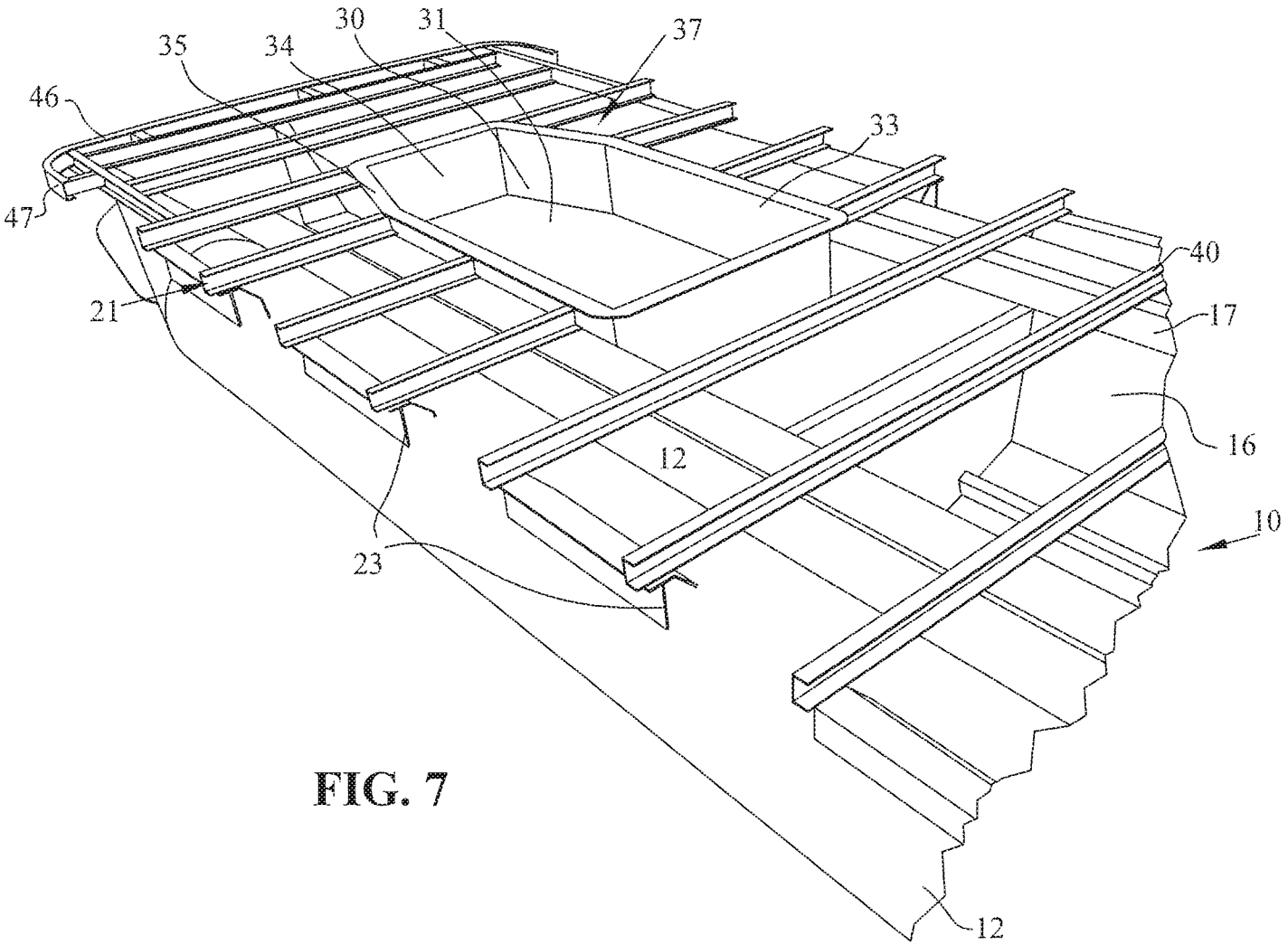
FIG. 7 is a perspective view from the port/stern side of the pontoon deck frame assembly and recessed deck portion of FIG. 1.
Figure 8:
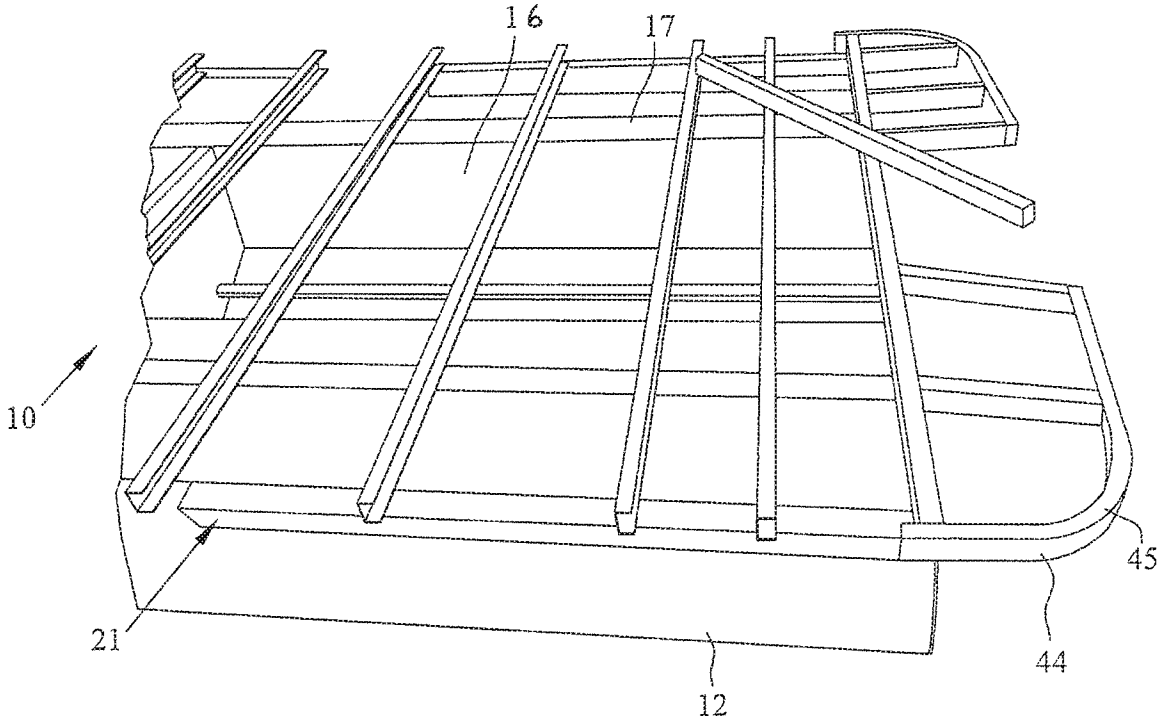
FIG. 8 is a perspective view of the stern of the deck frame assembly of FIG. 1.
Figure 9:
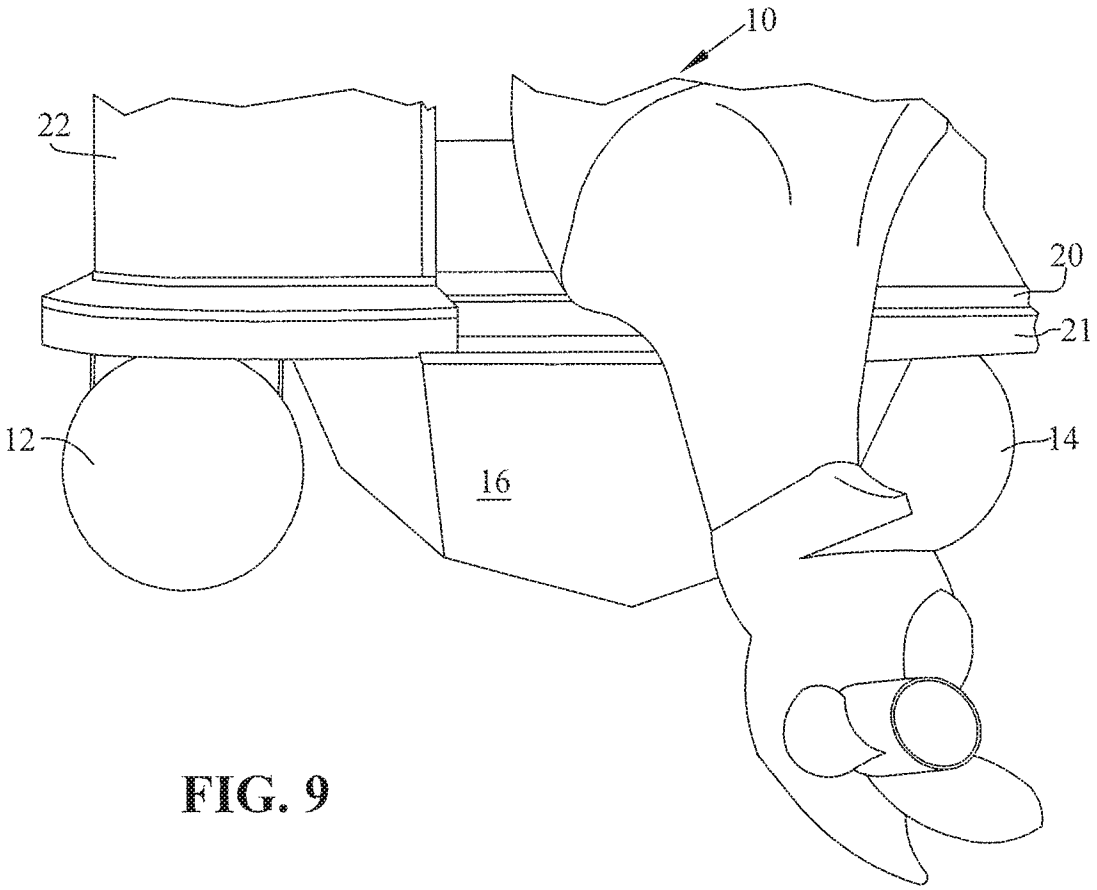
FIG. 9 is a view of the stern of the of the pontoon boat of FIG. 1.
Figure 10:
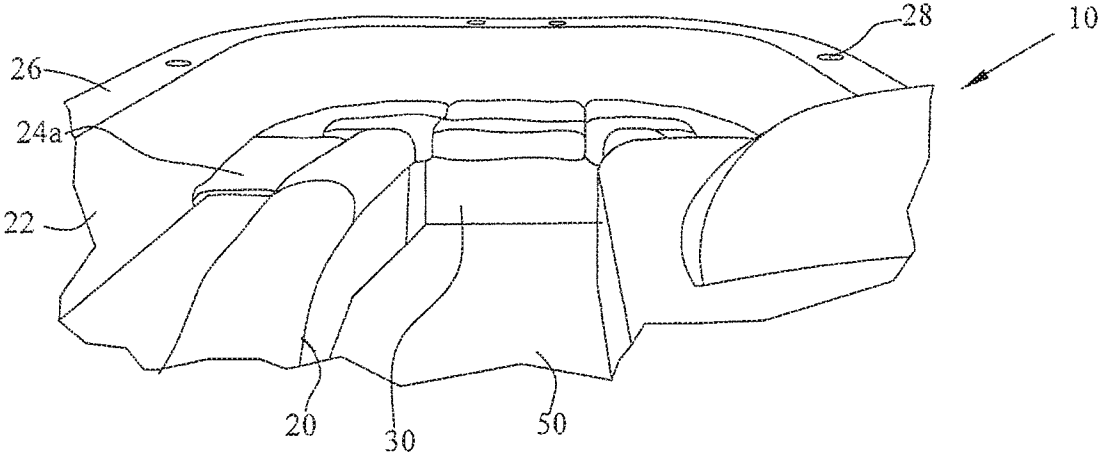
FIG. 10 is a perspective view of the recessed deck portion from the stern of the pontoon boat of FIG. 1.
Figure 11:
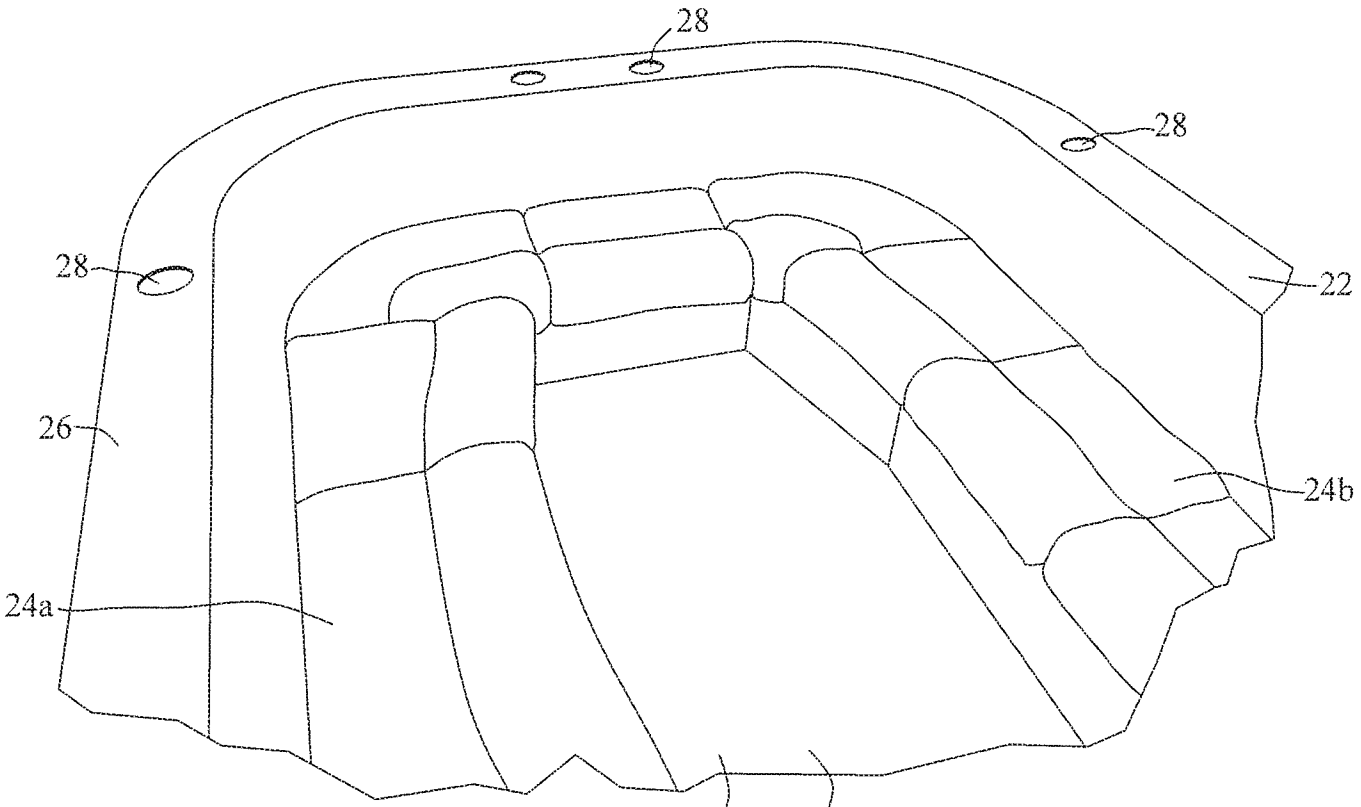
FIG. 11 is an enlarged perspective view of the recessed deck portion of the pontoon boat of FIG. 1.
Figure 12:
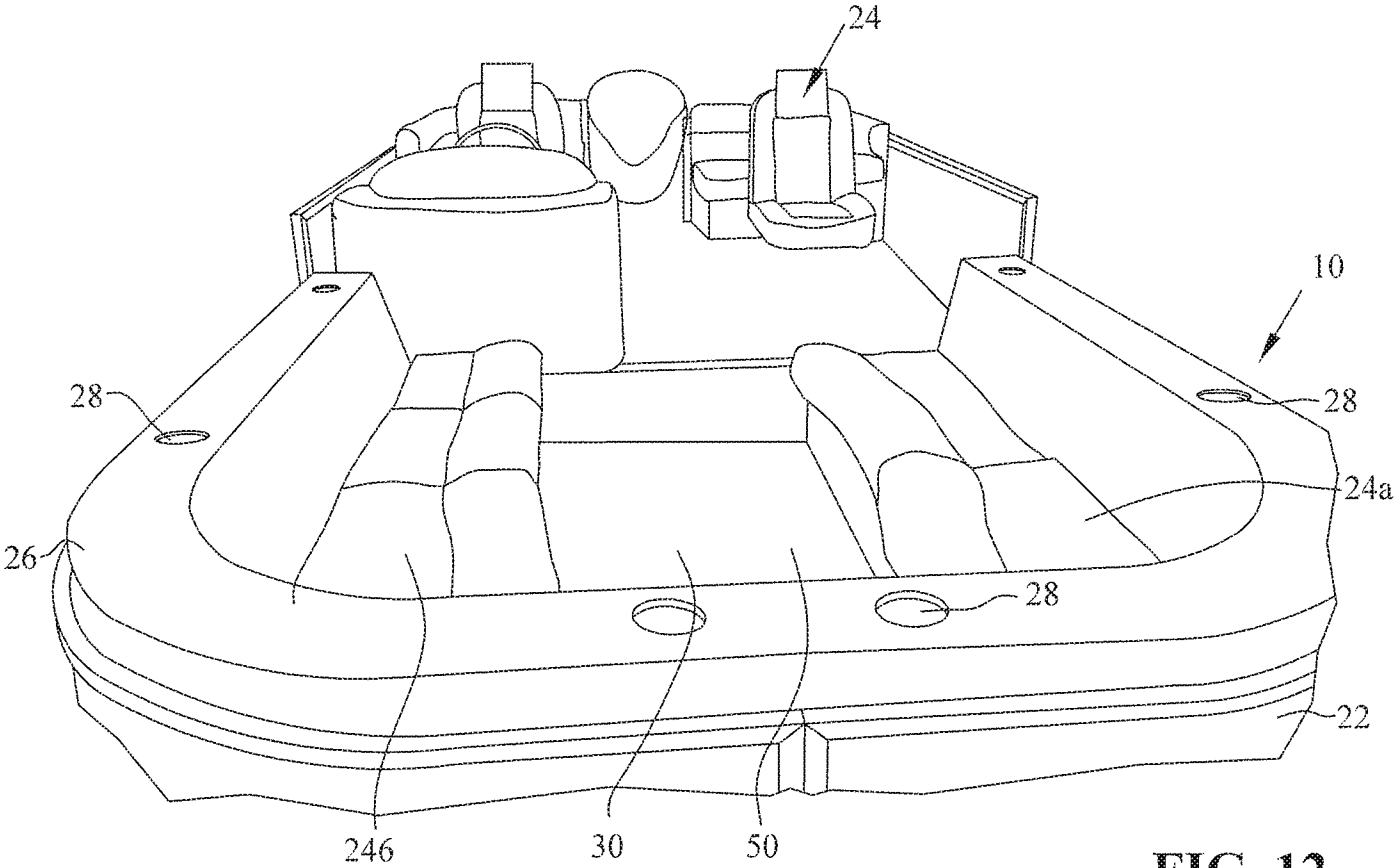
FIG. 12 is a perspective view of the bow and recessed deck portion of the pontoon boat of FIG. 1.

Referring now to FIG. 6-8, pontoon boat 10 is shown in a state of construction. A deck framework is shown generally indicated as 21, the framework supporting deck 20 in the completed pontoon. As best shown in FIG. 7, framework 21 is connected to pontoons 12 and 14 via support brackets 23. Also supported by framework 21 is a recessed deck portion 30. In this embodiment, recessed deck portion 30 has a generally rectangular cross-sectional configuration, which is tapered or narrowing toward the bow of boat 10. Recessed deck portion 30 includes a bottom 31, a rear panel 32, side panels 33, and a front panel 34. Recessed deck portion 30 also includes a lip or flange 35 extending about the upper periphery thereof for supporting the deck portion on framework 21. Deck portion 30 may be manufactured from a sheet metal, such as aluminum, and welded together to form a liquid-tight structure. The narrowed or taper front part of recessed deck portion 30 is shown generally indicated as 37.

Framework 21 includes a plurality of transverse members 40, which extend beneath deck 20, and transverse to the pontoons. Transverse members 40 are fabricated from aluminum in the embodiment shown and have a generally rectangular configuration. However, it should be appreciated that other materials and shapes may be utilized. Transverse members are mounted to support brackets 30 to connect the framework and deck to the pontoons. Deck framework 21 also include a stern portion 34 (see FIG. 8) which includes rounded corners 45. The deck framework also includes a bow section 46 (see FIG. 7) including rounded sections 47.

Middle pontoon or partial hull section 16 can also be seen in FIGS. 6 and 7. In this embodiment, pontoon 16 is closed on the bottom, but open toward framework 21 and is attached and mounted to transverse members 40, by means of a flange 17 extending around middle pontoon 16.

Now referring to FIGS. 9-12, clear views of pontoon boat 10 are depicted. In these views, it can be seen that railing 22 may include an upper ledge 26 having cup holders therein in perspective views of seats 24*a* and 24*b* facing and straddling recessed deck portion 30. Seat cushions 24*a* and 24*b* may be attached to or placed directly on deck 20 as the recessed deck portion allows for passengers feet and legs to extend down thereinto without the need to place the cushions on raised seat platforms or frames to elevate the seat cushions. This embodiment, recessed deck portion 30 includes a liner 50, which may be made from wood or any suitable material. In this embodiment, the liner only covers bottom 31 of the recessed deck portion 30; however, liner may also include sides be of a non-slip material which can be removed and cleaned.

Figure 13:
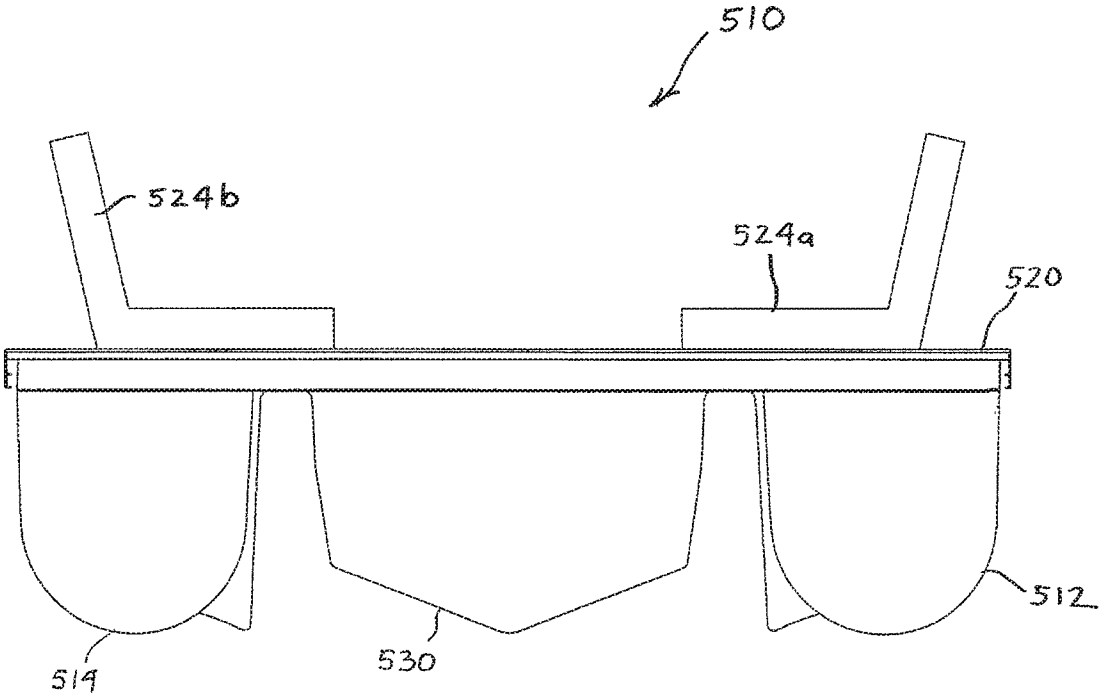
FIG. 13 is an end view of another embodiment of the invention wherein the recessed deck portion and other parts of the boat are formed from fiber reinforced plastic.

Now referring to FIG. 13, another embodiment of a boat with a recessed deck portion is shown generally indicated as 510. Boat 510 has a somewhat similar design as boats 110, 210, 310, and 410, except that boat 510 is manufactured using a fiber-reinforced plastic or fiberglass. Boat 510 includes pontoons 512 and 514, a deck 520, seats 527*a* and 524*b*, and a recessed deck portion 530. Deck 520 and recessed deck portion 530 are FRP/fiberglass, and side pontoons 512 and 514 may be either aluminum or FRP/fiberglass. The supporting structure may be either traditional or FRP/fiberglass.

Also, it should be noted that the recessed deck portion shown and described above and/or other similar configurations may be used on a pontoon boat and covered with a full or partial cabin area. The advantage is that lowering a portion of the deck and placing a cabin on top will allow standing room in the cabin at a cabin height above the deck that is lower than would otherwise be required. For example, a recessed deck portion extending 2' below the deck and a cabin of 4' height extending above the deck would allow individuals 6' and under to stand upright in the cabin while only having the cabin height extending 4' above the deck. This allows for better visibility for the captain on the pontoon boat as well as passengers and also makes for a more esthetically pleasing, sleeker design.

While the invention has been taught with specific reference to these embodiments, one skilled in the art will recognize that changes can be made in form and detail without departing from the spirit and scope of the invention. Therefore, the described embodiments are to be considered, therefore, in all respects only as illustrative and not restrictive. As such, the scope of the invention is indicated by the following claims rather than by the description.

The invention claimed is:

1. A pontoon boat comprising:

a plurality of pontoons;

a deck frame supported by the plurality of pontoons, the deck frame defining a bow side, a stern side, a port side, and a starboard side;

a deck supported by the plurality of pontoons;

a first seating area having a first floor at a first height;

a second seating area having a second floor at a second height lower than the first height, the second seating area being longitudinally forward of the first seating area, the first floor and the second floor each intersecting a longitudinal center plane of the pontoon boat; and at least one step at a junction between the first seating area and the second seating area, wherein the deck frame includes a recessed portion to accommodate the second seating area, the recessed portion including a flange that extends outward from an upper end of the recessed portion, wherein the deck frame includes a first support member, a second support member, and a plurality of cross members, the first and second support members each extending longitudinally from the bow side to the stern side of the deck frame, and the plurality of cross members extending from the port side to the starboard side of the deck frame, across both of the first and second support members, wherein at least one of the plurality of cross members is interrupted by the recessed portion, and wherein the flange rests upon the at least one of the plurality of cross members that is interrupted.

2. The pontoon boat of claim 1, wherein the first seating area is an operator seating area rearward of the second floor.

3. The pontoon boat of claim 1, wherein the second seating area includes at least one passenger seat having a seat surface and a seat back, and a cup holder positioned at a height corresponding to an upper surface of the seat back.

4. The pontoon boat of claim 1, wherein the plurality of pontoons includes at least a pair of pontoons running longitudinally beneath the boat and providing buoyancy thereto.

5. The pontoon boat of claim 4, wherein the deck frame is fixed to the plurality of pontoons and supports the first floor and the second floor.

6. The pontoon boat of claim 1, wherein the recessed portion is contained in a middle pontoon or a partial hull extending longitudinally between the pair of pontoons.

7. The pontoon boat of claim 1, further comprising:

a first railing extending upwardly from and at least partially around the first seating area to a first top end; and a second railing extending upwardly from and at least partially around the second seating area to a second top end, the second top end lower than the first top end.

8. The pontoon boat of claim 7, wherein the second seating area is a passenger's seating area including:

a first passenger seat oriented such that a seated passenger faces sideways toward one of a starboard side and a port side of the pontoon boat, the first passenger seat having a first passenger seating surface and a first seat back extending upwardly from the first passenger seating surface; and a second passenger seat oriented such that a seated passenger faces sideways toward the other of the starboard side and the port side of the pontoon boat, the second passenger seat having a second passenger seating surface and a second seat back extending upwardly from the second passenger seating surface.

9. The pontoon boat of claim 8, wherein the second railing includes an upper ledge and the upper ledge includes cup holders, the first seat back and the second seat back each having an upper surface at the upper ledge.

10. The pontoon boat of claim 8, further comprising a driver seat located in the first seating area, the first passenger seat and the second passenger seat are located forward of the driver seat.

11. The pontoon boat of claim 1, wherein the first floor of the first seating area extends in a first horizontal plane and the second floor of the second seating area extends in a second horizontal plane spaced below the first horizontal plane.

12. The pontoon boat of claim 1, wherein the second seating area is a passenger seating area including:

a recessed deck portion supporting the second floor;

a first passenger seat facing a starboard side of the boat and toward the recessed deck portion; and a second passenger seat facing a port side of the boat and oriented toward the recessed deck portion.

13. The pontoon boat of claim 12, wherein the first and second passenger seats and a footwell disposed therebetween together extend across a majority of a port-to-starboard lateral extent of the pontoon boat.

14. The pontoon boat of claim 1, wherein the recessed portion is disposed between segments of the at least one of the plurality of cross members that is interrupted.

15. The pontoon boat of claim 1, wherein the first and second supporting members are coupled to the plurality of pontoons via one or more brackets, and wherein the plurality of cross members extend transverse to the plurality of pontoons.

16. A pontoon boat comprising:

a plurality of pontoons;

a deck frame supported by the plurality of pontoons, the deck frame defining a bow side, a stern side, a port side, and a starboard side;

a deck supported by the plurality of pontoons;

a railing supported on the deck and including a starboard section and an opposing port section each extending from a front end to a rear end, the deck including a front portion positioned forward of the front end of the railing and a rear portion positioned rearward of the front end of the railing;

a first seating area positioned between the starboard section of the railing and the port section of the railing, the first seating area having a first floor at a first height, the first seating area including a first forward facing seat and a second forward facing seat;

a second seating area positioned between the starboard section of the railing and the port section of the railing, the second seating area having a second floor at a second height lower than the first height, the second seating area including a third seat and a fourth seat, the fourth seat facing the third seat, the second floor being positioned between the third seat and the fourth seat; the third seat being longitudinally forward of the first forward facing seat of the first seating area and the fourth seat being longitudinally forward of the second forward facing seat of the first seating area, wherein the deck frame includes a recessed portion to accommodate the second seating area, the recessed portion including a flange that extends outward from an upper end of the recessed portion, wherein the deck frame includes a first support member, a second support member, and a plurality of cross members, the first and second support members each extending longitudinally from the bow side to the stern side of the deck frame, and the plurality of cross members extending from the port side to the starboard side of the deck frame, across both of the first and second support members, wherein at least one of the plurality of cross members is interrupted by the recessed portion, and wherein the flange rests upon the at least one of the plurality of cross members that is interrupted.

17. The pontoon boat of claim 16, wherein the first seating area and the second seating area are both located in the rear portion of the deck.

18. The pontoon boat of claim 16, wherein at least one of the third seat and the fourth seat includes a seat surface and a seat back, a cup holder positioned at a height corresponding to an upper surface of the seat back.

19. The pontoon boat of claim 18, wherein:

the recessed portion is contained in a middle pontoon or a partial hull extending longitudinally between a first pontoon and a second pontoon of the plurality of pontoons.

20. The pontoon boat of claim 16, wherein the first floor of the first seating area extends in a first horizontal plane and the second floor of the second seating area extends in a second horizontal plane spaced below the first horizontal plane.

21. The pontoon boat of claim 20, wherein the first floor and the second floor each intersect a longitudinal center plane of the pontoon boat.

22. The pontoon boat of claim 16, wherein the recessed portion is disposed between segments of the at least one of the plurality of cross members that is interrupted.

23. The pontoon boat of claim 16, wherein the first and second supporting members are coupled to the plurality of pontoons via one or more brackets, and wherein the plurality of cross members extend transverse to the plurality of pontoons.

* * * * *